US005152114A

United States Patent [19]

Beazley et al.

[11] Patent Number: 5,152,114

[45] Date of Patent: Oct. 6, 1992

[54] BUILDING STRUCTURES

[75] Inventors: Mark D. Beazley, Nerang; Gordon Stuart, Holland Park, both of Australia

[73] Assignee: El Barador Holdings Pty. Ltd., Nerang, Australia

[21] Appl. No.: 459,700

[22] PCT Filed: Aug. 12, 1988

[86] PCT No.: PCT/AU88/00297

§ 371 Date: Jan. 31, 1990

§ 102(e) Date: Jan. 31, 1990

[87] PCT Pub. No.: WO89/01549

PCT Pub. Date: Feb. 23, 1989

[30] Foreign Application Priority Data

| | | | |
|---|---|---|---|
| Aug. 13, 1987 | [AU] | Australia | PI3703 |
| Mar. 17, 1988 | [AU] | Australia | PI7287 |
| Mar. 17, 1988 | [AU] | Australia | PI7288 |
| Apr. 22, 1988 | [AU] | Australia | PI7863 |
| May 24, 1988 | [AU] | Australia | PI8404 |

[51] Int. Cl.[5] ..... E04B 1/02; E04B 1/38

[52] U.S. Cl. ..... 52/264; 52/90; 52/243; 52/262; 52/270; 52/285; 52/293; 52/299

[58] Field of Search ..... 52/264, 90, 92, 299, 52/293, 581, 586, 243, 82, 284, 285, 262, 270

[56] References Cited

U.S. PATENT DOCUMENTS

| | | | |
|---|---|---|---|
| 1,082,937 | 12/1931 | Douglass | 52/90 |
| 1,793,188 | 2/1928 | Noerenberg . | |
| 2,438,604 | 3/1948 | Gogerty | 52/299 |
| 2,457,148 | 12/1948 | Hall et al. | 189/37 |
| 2,710,679 | 6/1955 | Bibb et al. | 189/36 |
| 2,856,039 | 10/1958 | Hawkinson | 189/34 |
| 2,982,055 | 5/1961 | Thompson | 50/56 |
| 3,236,014 | 2/1966 | Edgar . | |
| 3,330,084 | 7/1967 | Russell | 52/92 |
| 3,334,455 | 8/1967 | Russell | 52/586 |
| 3,343,309 | 9/1967 | Netz et al. | 52/28 |
| 3,780,481 | 12/1973 | Tomkins | 52/586 |
| 3,886,699 | 6/1975 | Bergmann . | |
| 3,971,172 | 7/1976 | Gentil . | |
| 4,275,534 | 6/1981 | Porter | 52/82 |
| 4,435,940 | 3/1984 | Davenport . | |
| 4,596,100 | 6/1986 | Grocott | 52/586 |

FOREIGN PATENT DOCUMENTS

| | | |
|---|---|---|
| 2119383 | 11/1984 | Australia . |
| 4754785 | 1/1986 | Australia . |
| 3540027 | 5/1986 | Fed. Rep. of Germany . |
| 1294119 | 4/1962 | France . |
| 162932 | 4/1972 | New Zealand . |
| 18922 | 2/1981 | U.S.S.R. . |
| 808607 | 2/1981 | U.S.S.R. . |
| 913950 | 3/1982 | U.S.S.R. . |
| 10205 | 6/1985 | U.S.S.R. . |
| 1221184 | 3/1986 | U.S.S.R. . |
| 561506 | 5/1944 | United Kingdom . |
| 1529432 | 10/1973 | United Kingdom . |
| 1362019 | 7/1974 | United Kingdom . |
| 1553119 | 9/1979 | United Kingdom . |
| 2057529 | 4/1981 | United Kingdom . |
| 2164966 | 4/1986 | United Kingdom . |
| 2171731 | 9/1986 | United Kingdom . |
| 8602682 | 5/1986 | World Int. Prop. O. . |

OTHER PUBLICATIONS

CSTB/Bulletin Mensuel Des Avis Techniques, vol. 279, May 1987, Avis Techniques Feb. 1986-131, PBR System, Paris, France, p. 6, lines 10-35, Figures of pp. 4, 5.

USSR Document-"Lightweight Steel Structures".

USSR Document "Recommendations for the Technology of Manufacturing Laminated Enclosing Structures Using Foam Plastics".

USSR Document-"Civil Building Structures" (Tupolev).

*Primary Examiner*—Michael Safavi

*Attorney, Agent, or Firm*—Oblon, Spivak, McClelland, Maier & Neustadt

[57] ABSTRACT

A building structure has structural wall panels of metal skin/insulating foam/fibrous cement sheet (or structural plywood) laminate construction secured to a floor assembly by brackets which are bolted to longitudinal bearers and to roof truss frames by brackets to enable loads to be distributed through the wall panels, floor assembly and roof truss frames. The longitudinal bearers are formed of C-section beams secured back-to-back and the joists are secured by tabs extending fro the webs of the bearers.

16 Claims, 15 Drawing Sheets

BUILDING STRUCTURES

BACKGROUND OF THE INVENTION (1) Field of the Invention

This invention relates to improved building structures.

(2) Prior Art

Many methods of modular building construction have been proposed. While many of these have certain advantages (e.g. they are less expensive and allow the use of semi-skilled labor) over conventional building techniques, they generally have inherent problems which limit their flexibility in floor plan and ease of erection.

SUMMARY OF THE PRESENT INVENTION

It is an object of the present invention to provide a method of building construction which is relatively simple yet provides considerable flexibility.

It is a preferred object to provide a method which enables the loads on the building structure to be distributed throughout the structure.

It is a further preferred object to provide an innovative floor structure for buildings.

It is a further preferred object to provide an innovative roof structure for buildings.

Other preferred objects of the present invention will become apparent from the following description.

In one aspect the present invention resides in a building structure including:

a floor assembly supported on a plurality of stumps or piles;

a plurality of wall panels secured to the floor assembly;

a plurality of roof truss frames supported on and secured to the wall panels; and respective bracket means securing the wall panels to the floor assembly and the floor truss frames, each bracket being received between adjacent wall panels.

Preferably each wall panel has a peripheral frame, of roll-formed metal sections, to which is bonded the cladding sheets forming the interior and exterior wall. Preferably the panels are filled with an insulating foam core, the foam core combining with the cladding sheets to form a stressed skin sandwich panel. Preferably the wall panels form structural means which can distribute the load through the building structure.

Preferably the floor brackets to secure the wall panels to the floor assembly are of substantially L-shape in side view with a foot section arranged to be bolted to the floor assembly frame and a leg arranged to be received between, and bolted to, the stiles of adjacent wall panels.

Preferably the roof brackets to secure the wall panels to the roof truss frames has a leg arranged to be received between, and bolted to, the stiles of adjacent wall panels and a vertical threaded shaft' which passes through the truss frame to receive a nut fastener.

Preferably tab members at each end of each respective C-section beams enter the respective slots of the other C-section beam.

In a second aspect the present invention resides in a floor assembly including:

a peripheral frame having longitudinal bearers comprising a plurality of assembled structural I-beams, each I-beam being assembled from a pair of substantially identical C-section beams wherein each C-section beam has a web member interconnecting a pair of substantially parallel flange members directed to one resides in a roof truss frame of the type having a pair of inclined top chords and base chord braced by inclined struts wherein:

the chords and struts are formed of "top-hat" and/or C section sheet metal components and at each junction between two chords or a chord and a strut, one of the components is received within, and fixed to, the other of the components; and the metal components are roll-formed from sheet metal strip and have downwardly divergent side walls to enable the components to be nested together at the junction.

In a fourth aspect the present invention resides in a roof truss frame of the type having a pair of inclined top chords and a base chord braced by inclined struts wherein:

the top chord and struts are formed of "top hat" or C-section sheet metal components, the base chords are formed of modified "top-hat" section sheet metal components wherein the side flanges of the chord are coplanar and inclined to the vertical plane of the base chord; the metal components are roll-formed from sheet metal strip and have downwardly divergent side walls to enable the components to be nested together at the junction and at each junction between two chords or a chord and a strut, one of the components is received within, and fixed to, the other of the components.

Preferably the bottom chord extends beyond its junctions with the top chords to span two or more roof trusses arranged laterally to the first truss.

BRIEF DESCRIPTION OF THE DRAWINGS

To enable the invention to be fully understood, a number of preferred embodiments will now in which.

DETAILED DESCRIPTION OF THE PREFERRED EMBODIMENTS

Figure 1:
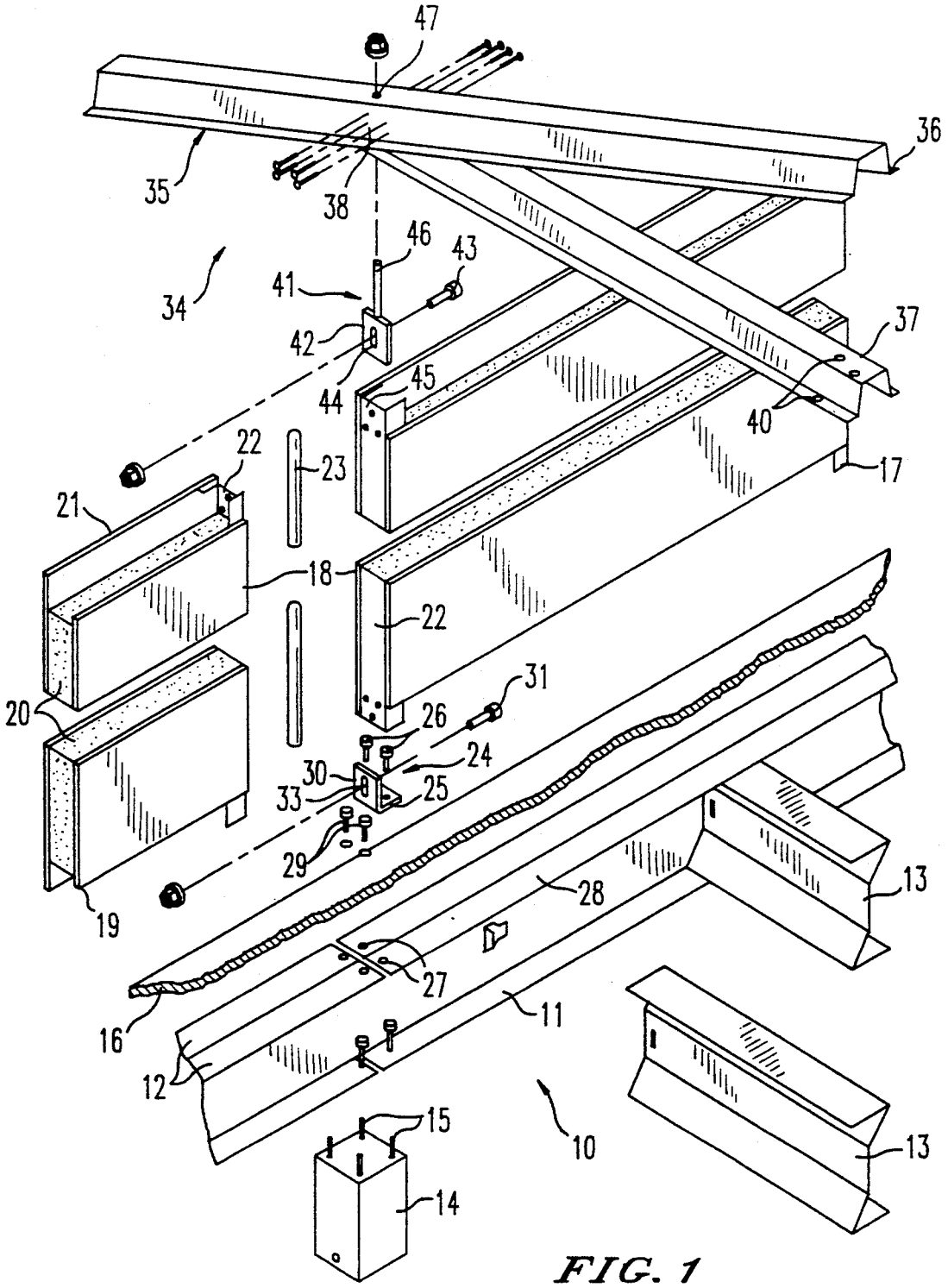
FIG. 1 shows a schematic layout of the method of building construction.

Referring to FIG. 1 a floor assembly 10 has longitudinal bearers 11, of substantially I-section formed of C-section beams 12 back-to-back, interconnected by transverse joists 13 of substantially Z-section. The C-section beams, and the bearers and joists, are secured together by tab-in-slot fastening means to be described in more detail with reference to FIGS. 2 to 8. The floor assembly 10 is supported on a plurality of stumps having adjustable stump caps 14 arranged to receive four studs 15 which secure the bearers 11 of the floor assembly 10 to the stumps 14.

A floor panel 16 is laid over the floor assembly 10.

The exterior walls 17 are formed of composite panels 18 (e.g. of sheet metal 19/polystyrene foam 20/ fibrous cement sheet 21 laminated construction) which has a peripheral frame with metal stiles 22 (and top and bottom rails) of substantially C-section. The panels 18 are arranged with their adjacent metal stiles 22 face-to-face, separated by an insulating/weather proofing strip 23.

The sheet metal outer skin and fibrous cement sheet inner skin are bonded to the peripheral metal frame before the polystyrene insulating foam is foamed in the cavity of the wall panel. The resultant panels form a structural member which can distribute a load applied to e.g. one corner of the panel throughout the panel. Internal wall panels are of generally the same construction, with the sheet metal skin being replaced by plasterboard or other suitable sheet material.

The bases of the wall panels 18 are secured to the floor assembly 10 by L-shaped brackets 24. Each bracket has a foot 25 with two holes which receive studs 26 which pass through the floor panel 16 and are received in holes 27 in the upper flanges 28 of the bearers 11. As shown, a further two studs 29, secures the floor panel 16 to the bearers at the junction of the bearer members over a stump 14.) Each bracket 24 has a vertical leg 30 which is received between the adjacent stiles 22 of two wall panels 18 and the leg is secured thereto by a single bolt 31 which passes through aligned holes 32 in the stiles 22 and the hole 33 in the leg 30.

The roof assembly 34 (to be described in more detail with reference to FIGS. 9 to 24) is supported on a plurality of roof truss frames 35, where the top and bottom chords 36, 37 are formed of "top-hat" roll-formed metal sections which, at the junction 38 thereof, are nested together and fixed by "Tek-screws" 39. (The interior wall panels (not shown) can be bolted to the bottom chord 37 via holes 40 therein.)

To secure the roof truss frames 35 to the exterior wall panels 18, a bracket 41 has a plate 42 received between the adjacent stiles 22 of two panels 18 and is secured thereto by a bolt 43 passing through aligned holes 44, 45 in the plate 42 and stiles 22. A threaded stud 46 extends upwardly from the plate 42 and passes through aligned holes 47 in the top and bottom chords 36, 37 and receives a nut 48.

The brackets 24, 41 enable the wall panels 18 to be secured together and ties the wall panels 18 to the floor assembly 10 and the roof assembly 34 and also enables loads on the building structure to be distributed between the floor, walls and roof. In addition the brackets enable the components to be quickly and accurately connected together.

The general floor assembly 10, and the method by which the longitudinal bearers are produced from the C-section beams will now be described with reference to FIGS. 2 to 8.

Figure 2:
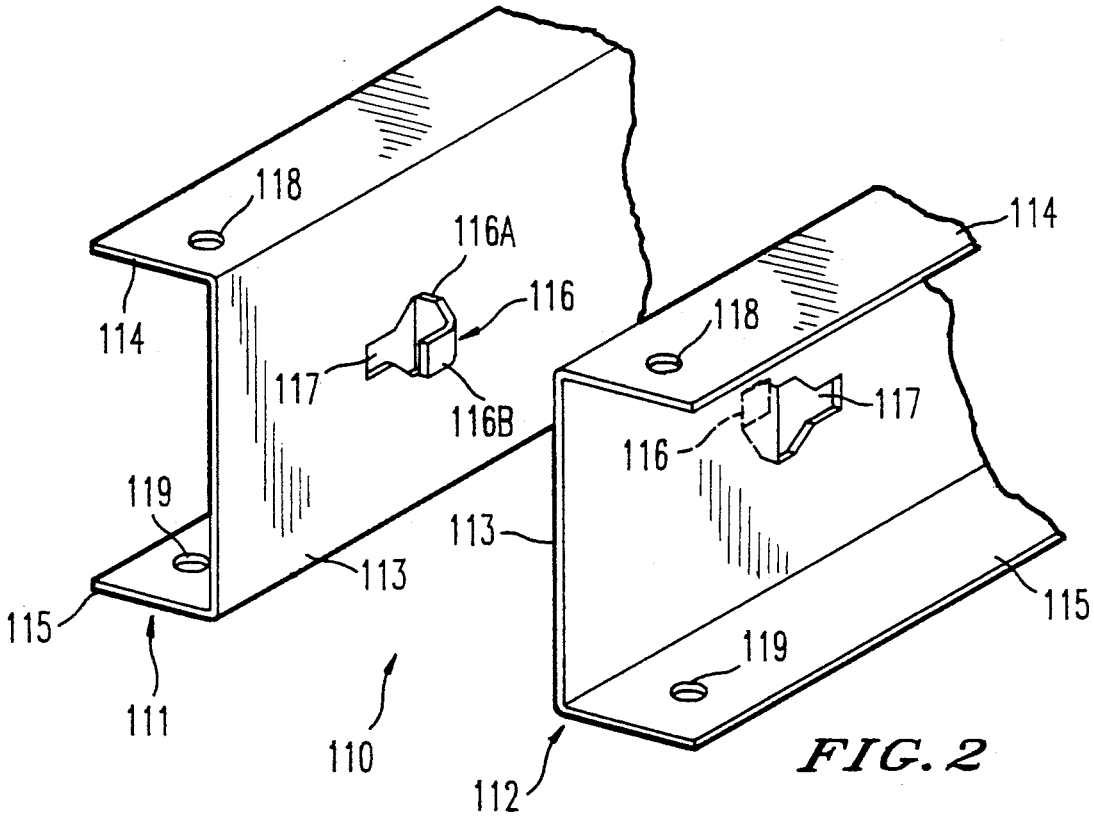
FIG. 2 is a perspective view of an I-beam, used in the floor structure before assembly.
Figure 3:
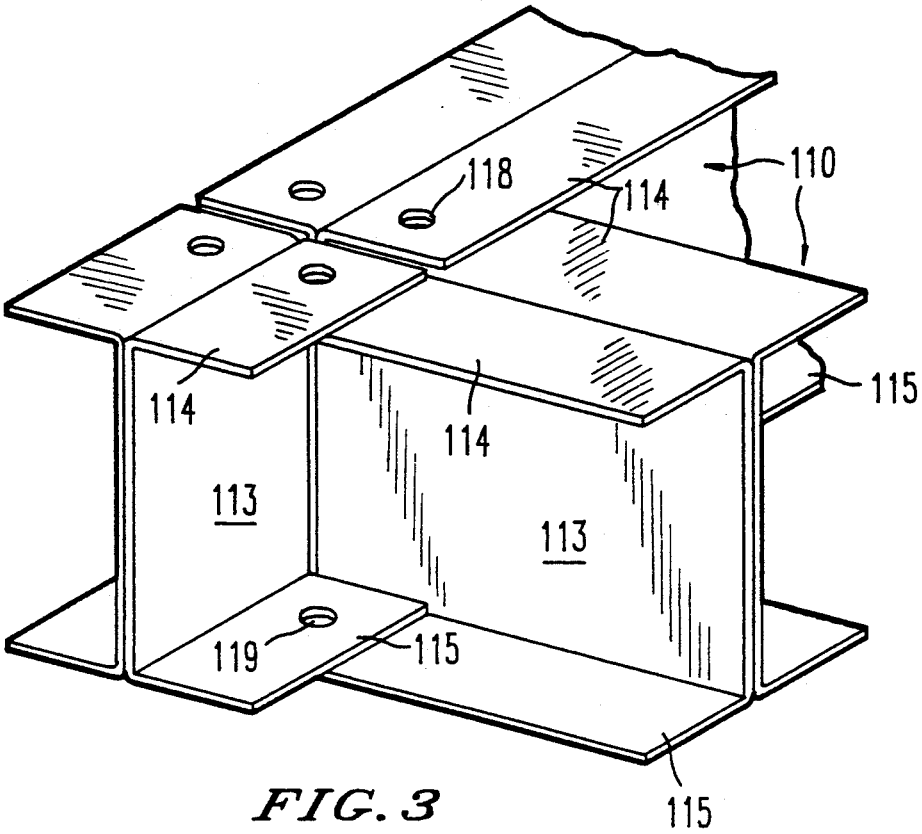
FIG. 3 is a perspective view of a 3-way beam connection in the floor assembly.
Figure 4:
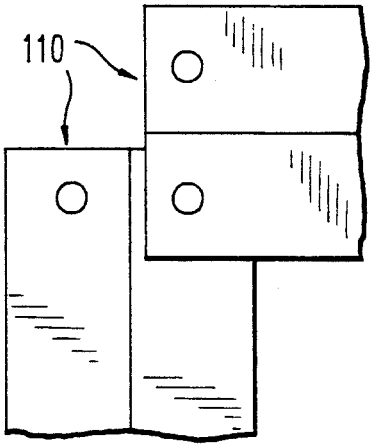
FIGS. 4 to 7 are plan views of a beam corner, beam joint, 3-way beam connection and a 4-way beam connection respectively in the floor assembly.
Figure 5:
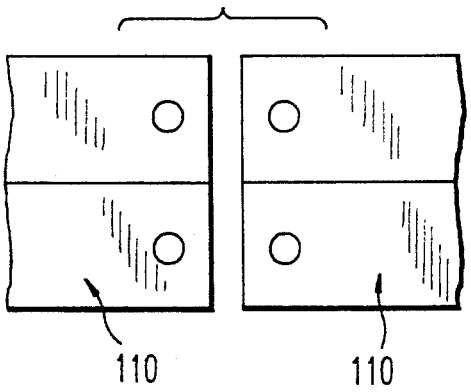
Figure 6:
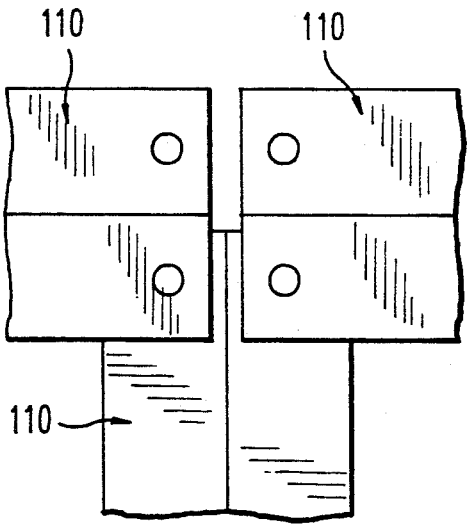
Figure 7:
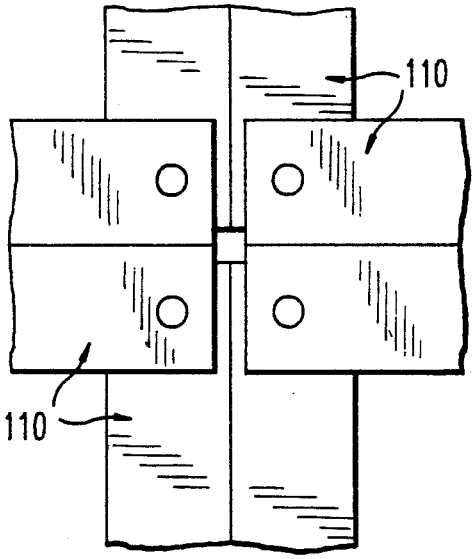

Referring to FIGS. 2 and 3, the assembled I-beam 110 comprises a pair of roll-formed C-section metal beams 111, 112 arranged with their respective webs 113 back-to-back and their upper and lower side flanges 114, 115 directed outwardly.

A plurality of tabs 116 are punched or otherwise formed out of the webs 113 of the C-section beams, only one tab per beam being shown. Each tab 116 has a leg 116A extending substantially perpendicular to the web 113 and a toe 116B substantially parallel to, but spaced from, the web 113. A respective slot 117 for each tab 116 remains in the web 113. As shown, the tabs 116 of the beams 111, 112 are oppositely directed to each other so that the tabs 116 of beam 111 enter the corresponding aligned slots 117 of beam 112 and vice versa.

When the beams 111, 112 are brought together, with the tabs 116 through the aligned slots 117, the tabs 116 of each beam are deformed, e.g. with a hammer, to cause the legs 116A and toes 116B to engage the web of the other beam to so secure the C-section beams 111, 112 together with a single assembled I-section beam 110, suitable for structural purposes.

Holes 118, 119 of different diameters, are provided in the side flanges 114, 115 respectively adjacent their ends, and in pairs at modular lengths along the flanges, to enable two or more of the I-section beams 110 to be secured together.

As shown in FIG. 3, the holes 118, 119 are spaced so that when two or more I-beams 110 are connected together, the ends of their webs 113 are slightly spaced, with their side flanges 114, 115 overlapped.

FIGS. 4 to 7 show how the assembled I-beams 110 may be connected together at a joint e.g. over a supporting stump or pier, where bolts passing through the holes 118, 119 connect the beams 110 to structural fixing brackets or stump head plates (provided with aligned holes) not shown.

Figure 8:
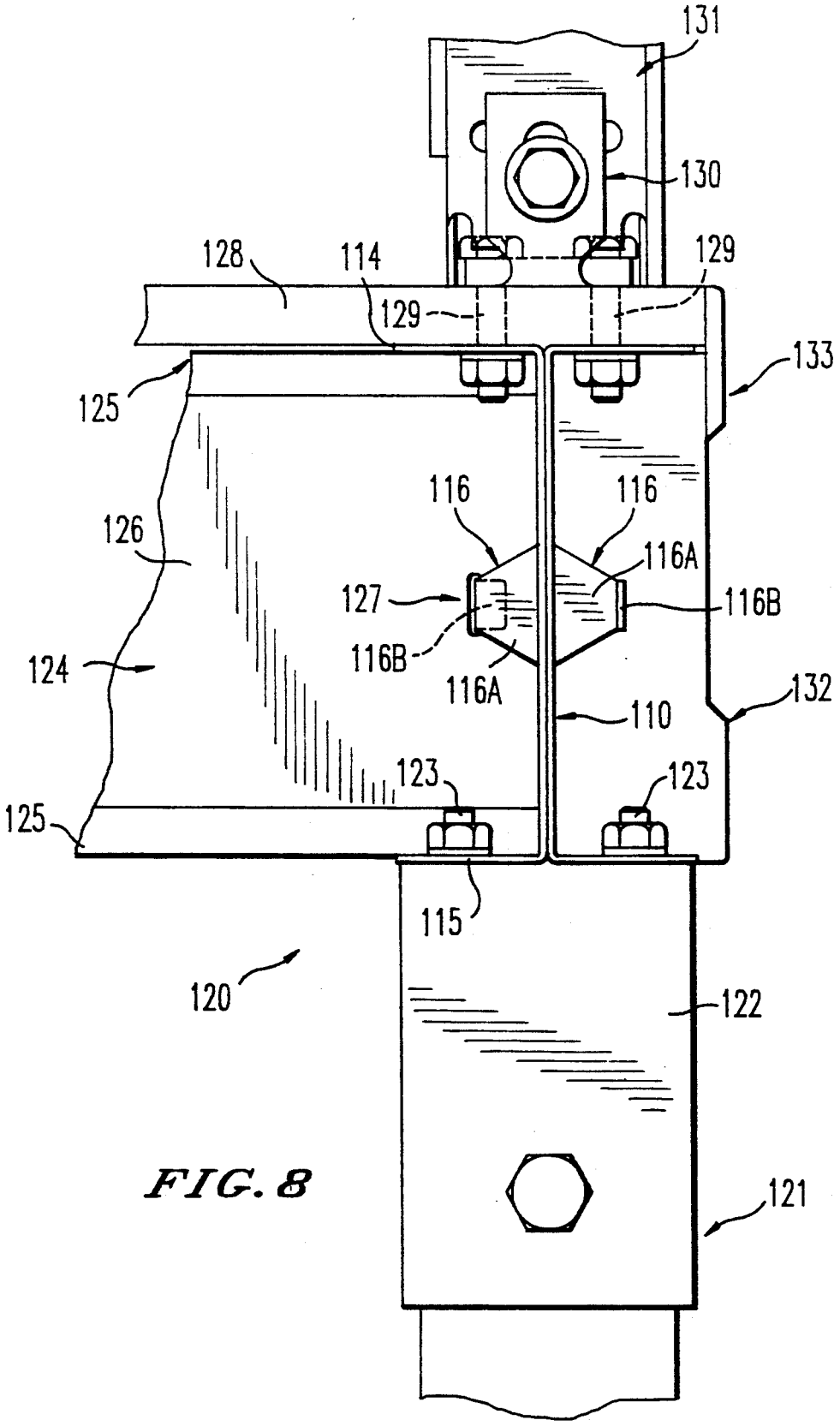
FIG. 8 is a sectional side view of a portion of the floor assembly.

FIG. 8 illustrates how the I-beams 110 are used as part of a floor assembly for a building, the beams also enabling a wall structure to be attached to the supporting stumps or piers.

The floor assembly 120 is supported on a plurality of building stumps 121. Each stump 121 has a rectangular cap 122 with four holes to receive bolts 123. The floor assembly 120 has a peripheral frame and cross-members formed of the assembled I-beams 110 interconnected by joists 124. Each joist 124 is of modified Z-section roll-formed steel, with top and bottom flanges 25 connected by a web 126.

A slot 127 is formed centrally in the web 126 adjacent each end and is engaged by one of the tabs 116 of the adjacent I-beam 110 to secure joist 124 to the I-beam 110 (the side flanges 125 of the joist being closely interfitted with the side flanges 114, 115 of the I-beam 110).

As shown, the hole 127 is spaced from the end of the joist 124 a distance substantially equal to the height of the leg 116A of the tab 116 and the toe 116B is received in the hole 127 and then deformed (e.g. with a hammer) to form a hook to secure the joist 124 and I-beam 110 together.

Bolts 123 through aligned holes (not shown) in the lower side flanges 125 of the joist 124, the I-beam 110 (i.e. holes 119) and the cap 122 of the stump 121 enable the floor assembly 120 to be secured to the stump 121. A floor panel 128 is laid over the floor assembly 120 and is clamped to the I-beams 110 by bolts 129 passing through the holes 118 in the I-beams, the floor panel 128 and angled fixing brackets 130 for wall panels 131. The floor panel 128 is fixed to the joists 124 by suitable screws, studs or adhesives.

A cover sheeting 132 is provided around the floor structure 120, to enclose the I-beam 110 of the peripheral frame, and weather-proofing is provided between the wall panels 131 and the cover sheeting 132 by suitable flashing 133.

If, at any time, the building is to be extended, the cover sheeting 132 and flashing 133 may be removed and joists 124 may be connected to the I-beams 110 i.e to extend to the right in FIG. 8. (The new joist 124 would be connected to the I-beam 110 by the free tabs 116 and the bolts 123, 129.)

The general roof assembly 34 will now be described in more detail with reference to FIGS. 9 to 24.

Figure 9:
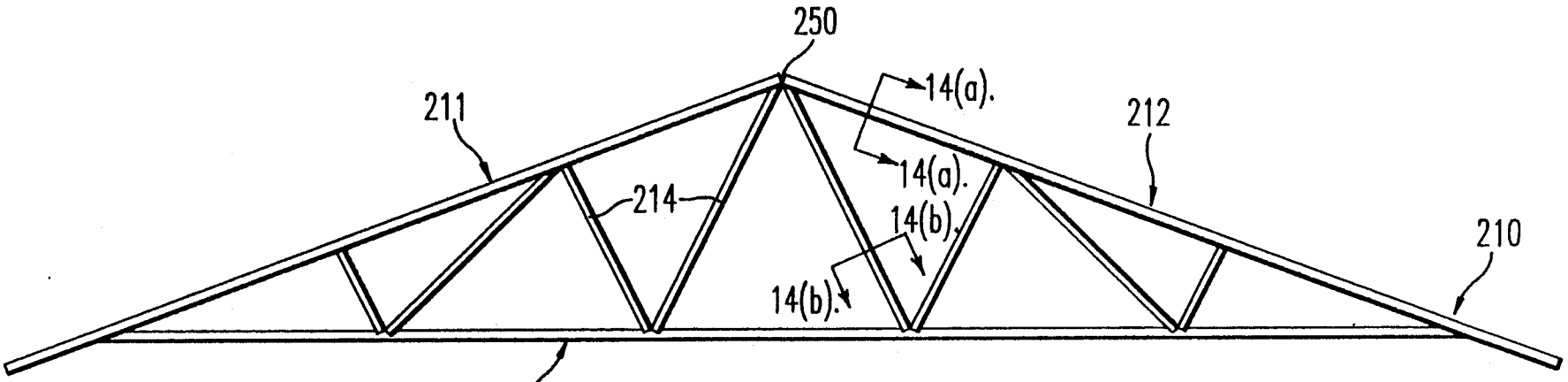
FIG. 9 is a front view of a "Warren" truss frame which may be used in the roof assembly.
Figure 10:
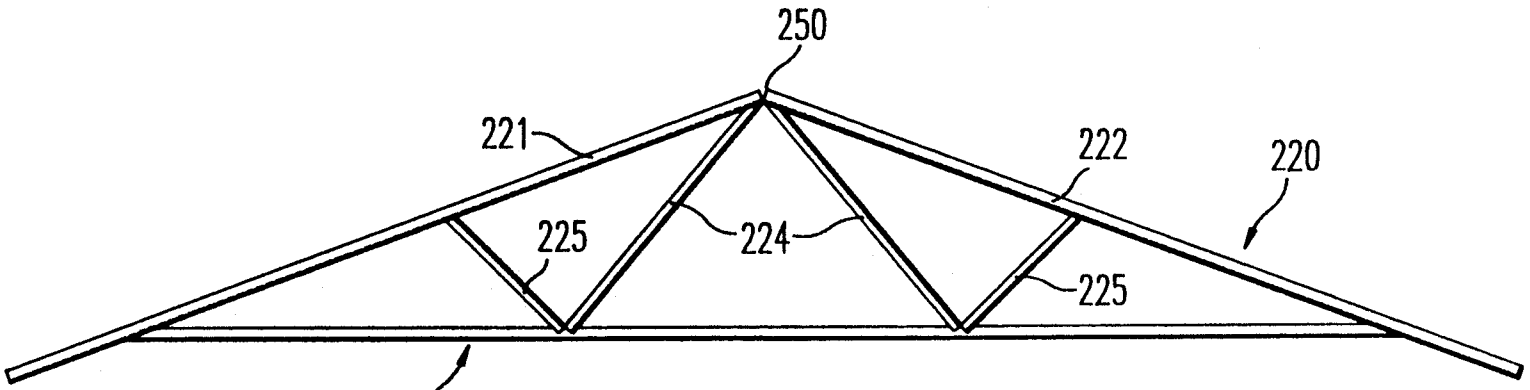
FIG. 10 is a front view of a "Fink" truss frame which may be used in the roof assembly.
Figure 14B:
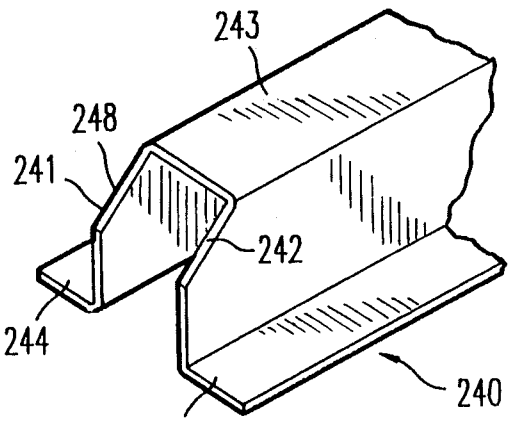
FIGS. 14(*a*) and (*b*) show how the alternative struts are notched.
Figure 14A:
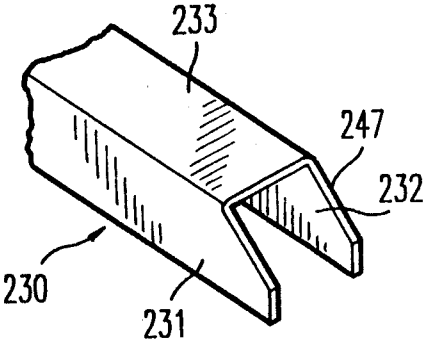

Referring to FIG. 9, the truss frame 210 is a "Warren" type truss frame which has a pair of top chords 211, 212 and a bottom chord 213 of "top-hat" cross-section roll-formed metal (see FIG. 14(*b*)) and diagonal struts 214 of the "top-hat" section or of "C" section rolled-formed metal (see FIG. 14(*a*)). FIG. 10 shows a "Fink" type truss frame 220 where the top chords 221, 222 and bottom chord 223 are of the "top-hat" section, the inner struts 224 are of the "top-hat" section and the outer strut 225 are of the "top-hat" section or of the "C" section.

Referring to FIG. 14(*a*), the "C" section components 230 have downwardly divergent side walls 231, 232 interconnected by a base web 233. The "top-hat" section components 240 (see FIG. 14*b*)) have side walls 241, 242 and a base web 243 configured as for the "C" section components 230, with the addition of laterally extending side flanges 244, 245 which are co-planar. As the side walls 231, 232 and 241, 242 are divergent, the components 230 and 240 can be nested together to enable adjacent side walls to be fixed together by studs or bolts, rivets or self-piercing fasteners (e.g. of the type known as "Tek-screws").

Figure 11:
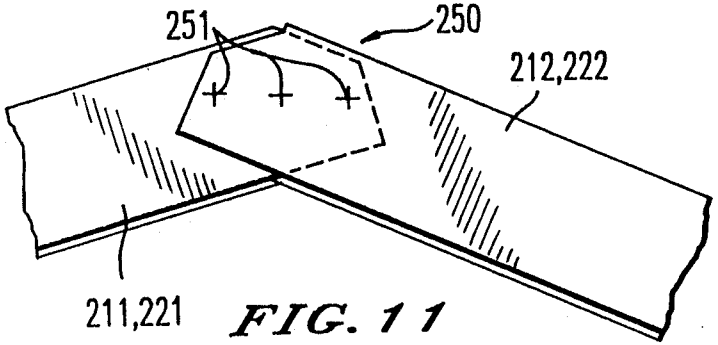
FIG. 11 is a front view of the apex of the truss frame.
Figure 12:
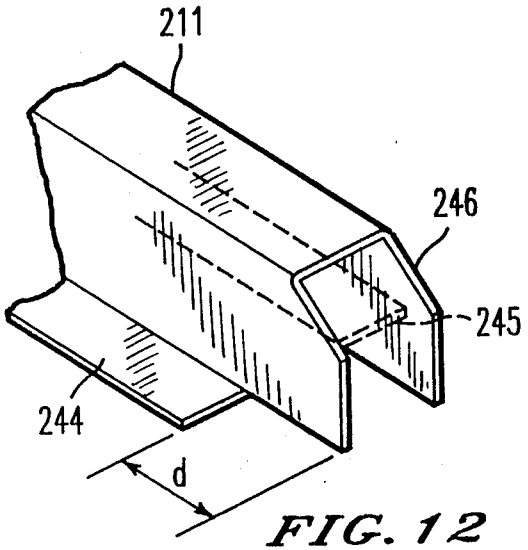
FIG. 12 is an isometric view showing how the top chords are notched at the apex.

Referring to FIGS. 11 and 12, the top chords 211, 212 and 221, 222 are notched as shown in FIG. 12, where the side flanges 244, 245 are terminated a preselected distance "d" from the inner ends of the chords and an inclined cut forms a relieved portion 246 in the upper portion of the inner ends of the chords.

When the two top chords 211, 212 and 221, 222 are brought together, one is nested within the other and their adjacent side walls are fixed with "Tek-s-crews" 251, thereby avoiding the need for connector plates or brackets.

The upper ends of the struts 214, 224, 225 are received within the top chords 211, 212 and 221, 222 and their adjacent side walls are fixed using "Tek-screws".

Figure 13:
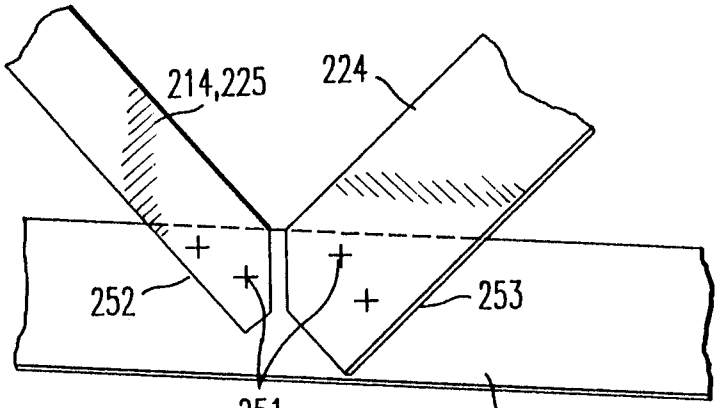
FIG. 13 is a front view of the junction of two struts with the bottom chord.
Figure 15:
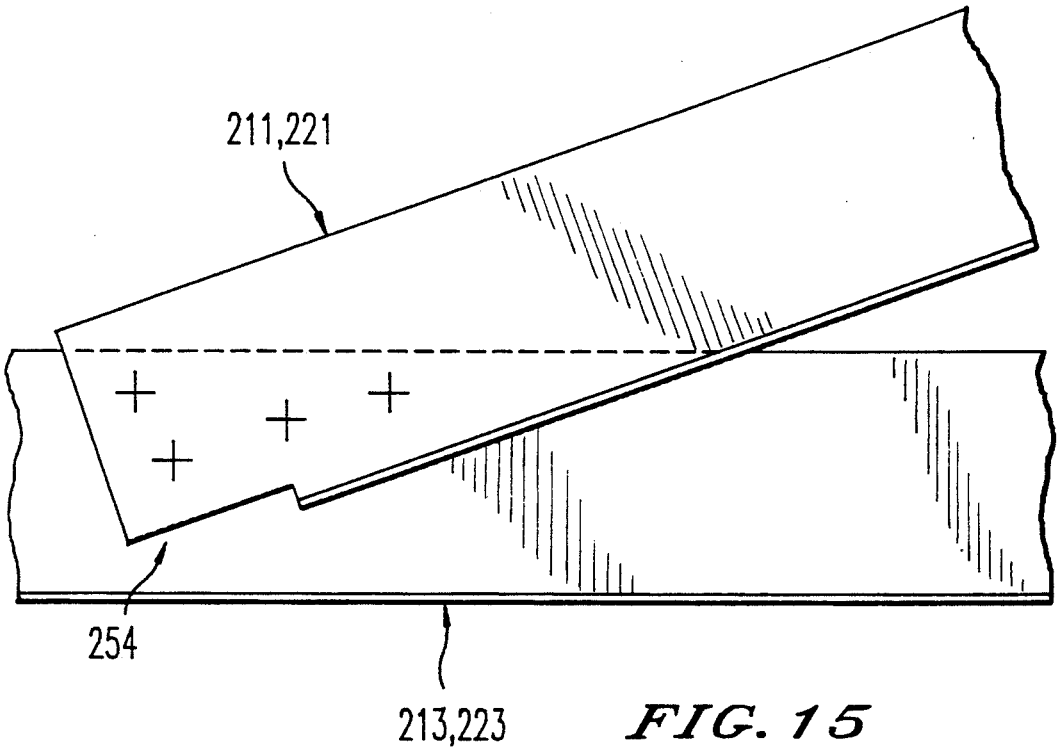
FIG. 15 is a side view of the junction of a top and bottom chord.
Figure 16:
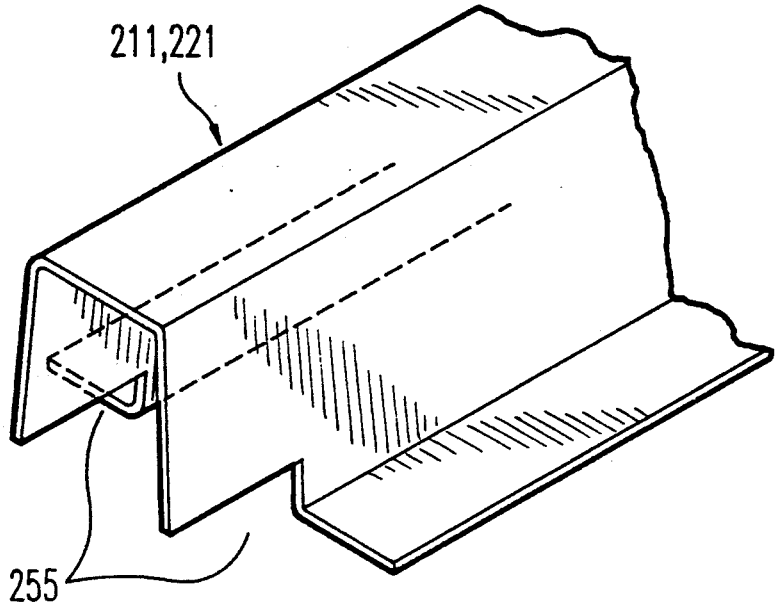
FIG. 16 is an isometric view showing how the top chords are notched at the junction with the bottom chord.

At the lower ends of the struts 214 and 224, 225, the ends are relieved, as shown in FIGS. 14(*a*) and 14(*b*) at 247 and 248 respectively. As shown in FIG. 13, the ends of the struts 211, and 224, 225 are placed over, and nestably receive, the bottom chords 213, 223. The adjacent side walls are then secured together with "Tek-screws" 251 at the junction 252, 253. Referring to FIGS. 15 and 16, the junctions 254 between the top chords 211, 212 and 221, 222 and the bottom chords 213, 223 are similar to the junctions 252, 253 in that the bottom chords are nested within, and fixed to, the top chords, the latter being notched on each side at 255 as shown in FIG. 16.

The overlapping junctions between the top and bottom chords, the top chords at the apex 250 and the chords and struts at junctions 252, 253, 254 results in truss frames with very high strength-to-weight ratios.

It is possible to partially assemble the truss frames, fold the frames down for transport and to complete assembly on site. Only a pair of fasteners are provided to connect the outer ends of the top chords to the bottom chords, the top chords not being connected at the apex, and only one pair of fasteners connects one end of each strut to either the top or bottom chord. This enables the semi-assembled truss frame to be folded down, with the chords and struts nested together, for transport. On site, the truss frame is opened out to the desired configuration and the assembly is completed. With this arrangement, transport costs are reduced while allowing more accurate final assembly on site than if the erectors were supplied only with the individual components.

Figure 17:
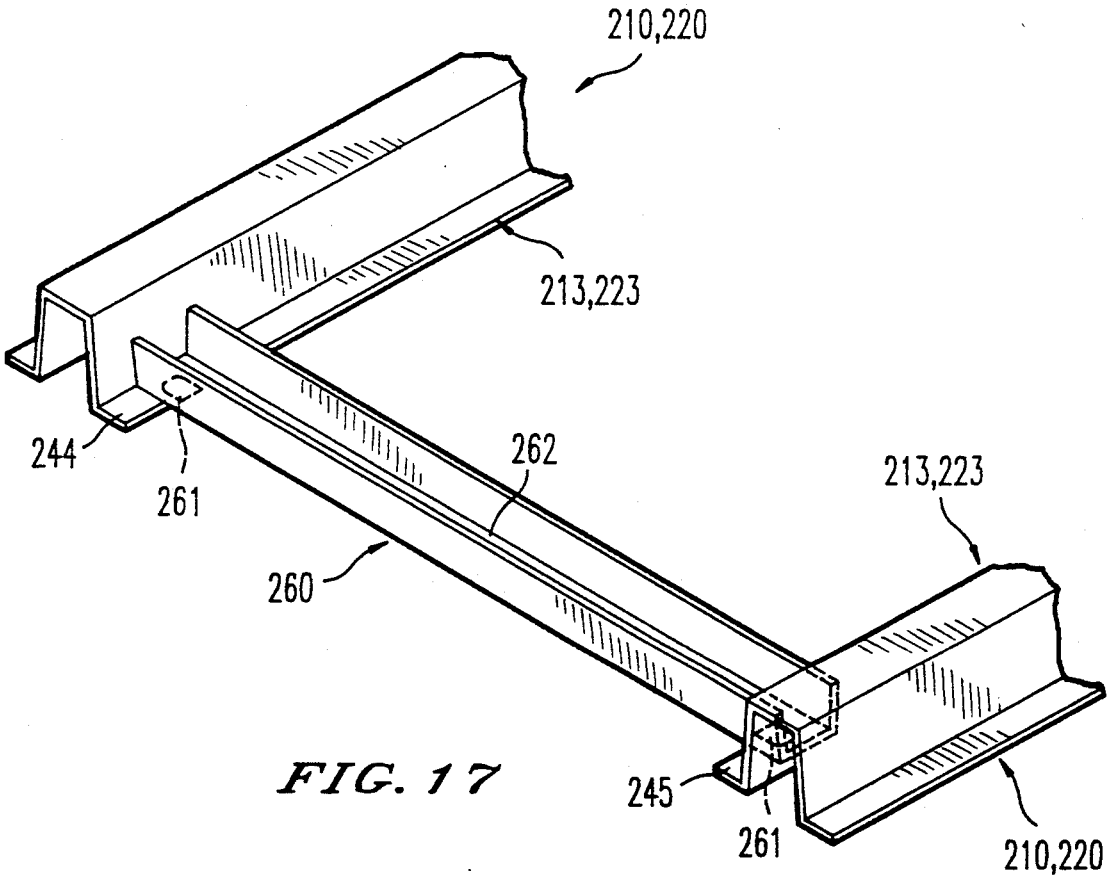
FIG. 17 is a perspective view of a ceiling batten connecting a pair of the roof trusses.
Figure 18:
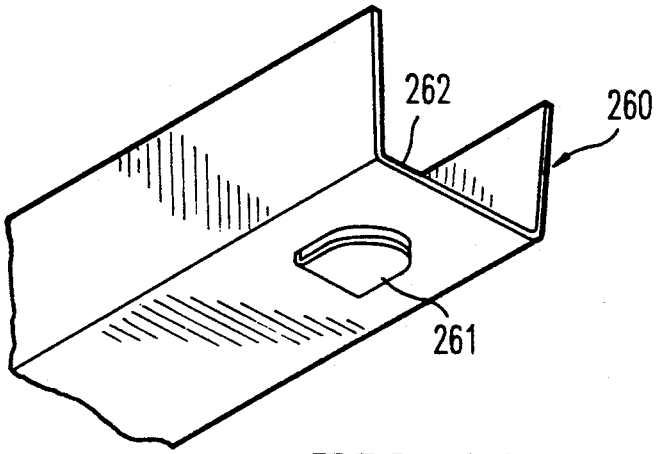
FIG. 18/ is an underside isometric view of one of the ceiling batten.

Referring now to FIGS. 17 and 18, when erected, adjacent roof truss frames 210, 220 are interconnected by parallel, spaced ceiling battens 260 of substantially channel section (see FIG. 18). A tab 261 is punched out of the central web 262 of the batten adjacent each end and is arranged to frictionally engage the adjacent side flanges 244, 245 of the adjacent bottom chord 213, 223.

The ceiling battens 260 are aligned with the side flanges 244, 245 and then rotated to cause the side flanges to be frictionally engaged between the tabs 261 and the central web 262.

When all the ceiling battens have been installed, the ceiling panels (not shown) are fixed to the ceiling battens 260 using fasteners (e.g. "Tek-screws"). By the provision of the tabs 261 at each end of the ceiling battens, and the frictional engagement between the ceiling battens and the bottom chords 213, 223 of the roof truss frames 210, 220, the necessity for separate fasteners is avoided.

Referring now to FIGS. 19 to 22, these show "diminishing" roof trusses which are employed at the junction of two wings of a building, where the gables on each are brought to a single point.

The trusses 220 of the main wing are of the "Fink" type shown in FIG. 10. The diminishing trusses 270 of the side wing are also of the "Fink" type (see FIG. 21) but may be of the "Warren" type (see trusses 72 of FIG. 22) if preferred. As shown in both FIGS. 19 and 20, the diminishing trusses 270 are of reducing width and height as they are provided up the trusses 220 of the main wing. Generally the main trusses 271 of the side wing will be the same as the trusses 220 of the main wing.

Figure 19:
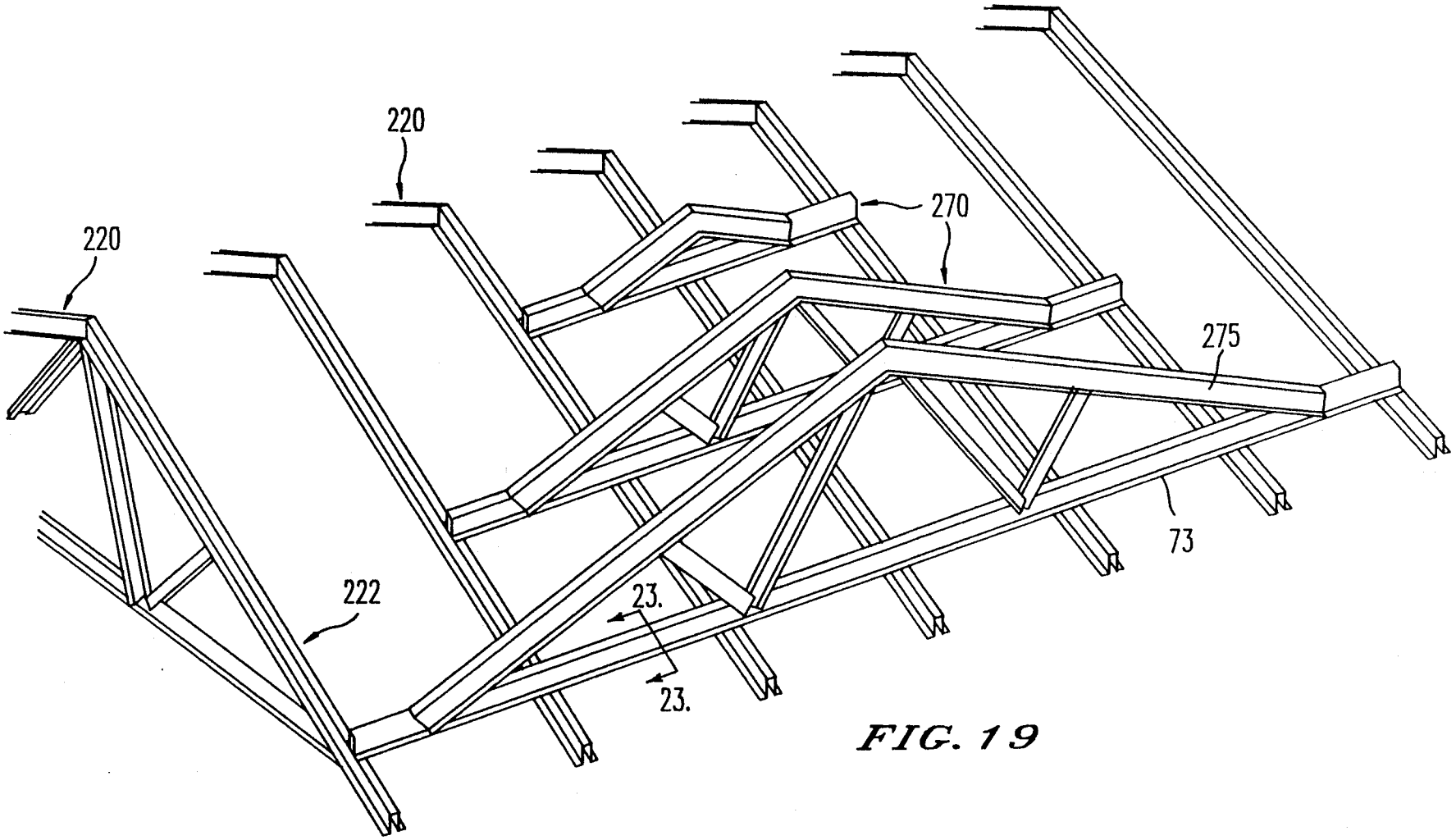
FIG. 19 is an isometric view of a plurality of diminishing roof trusses fixed to standard roof trusses at the junction of two sections of a building.
Figure 20:
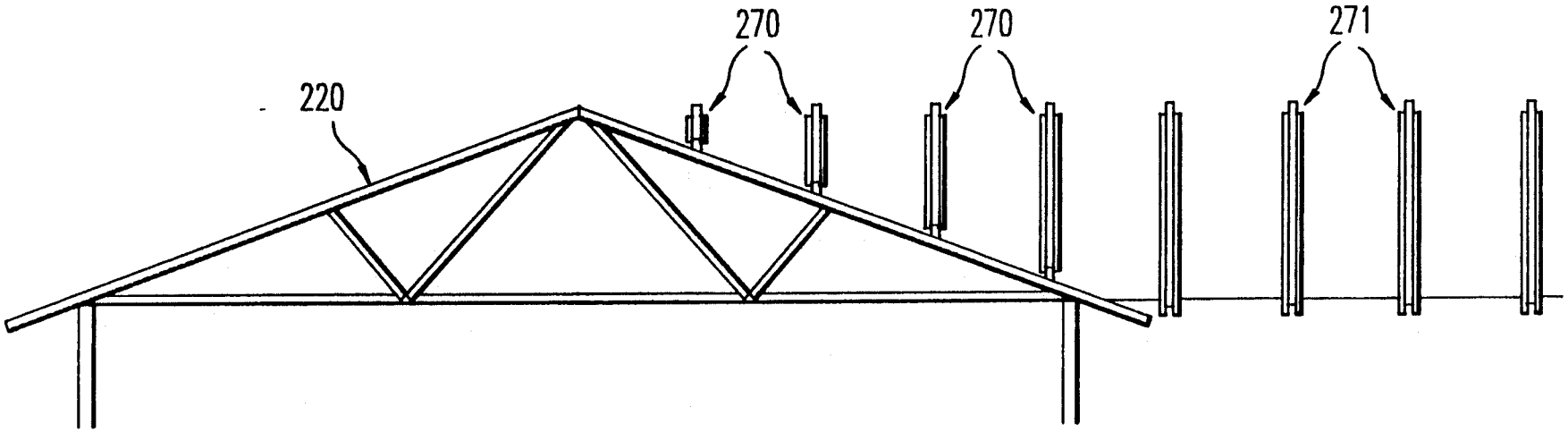
FIG. 20 is an end view corresponding to FIG. 19.
Figure 21:
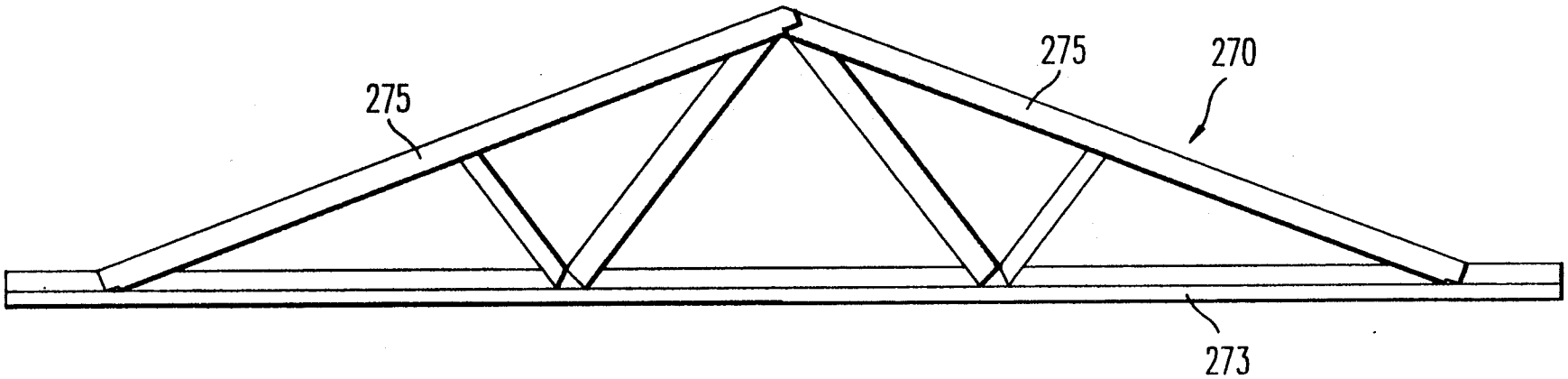
FIG. 21 is a front view of a "Fink" type diminishing truss frame.
Figure 22:
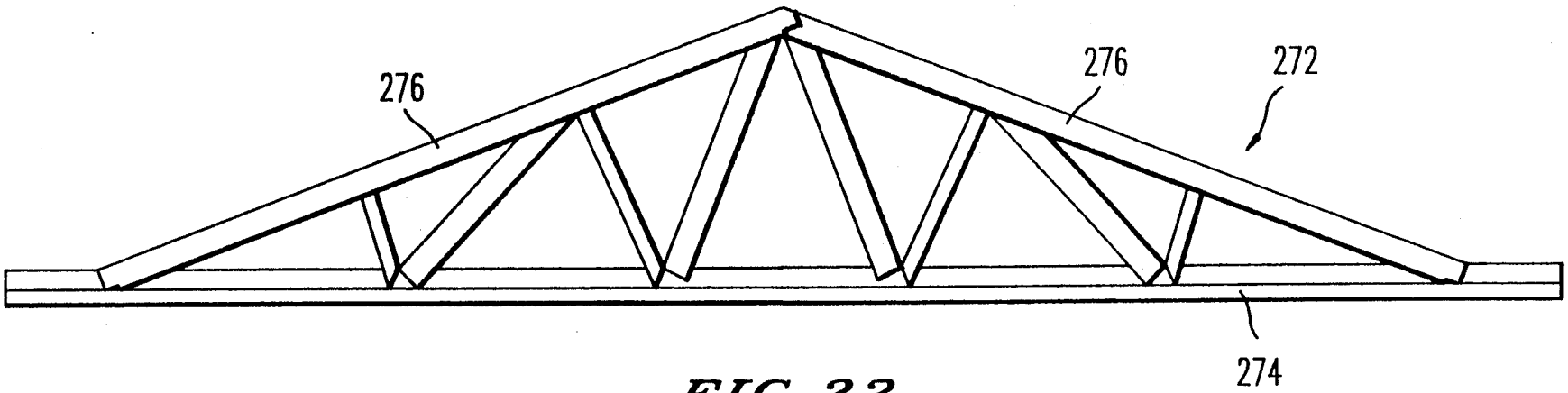
FIG. 22 is a front view of a "Warren" type diminishing truss frame.
Figure 23:
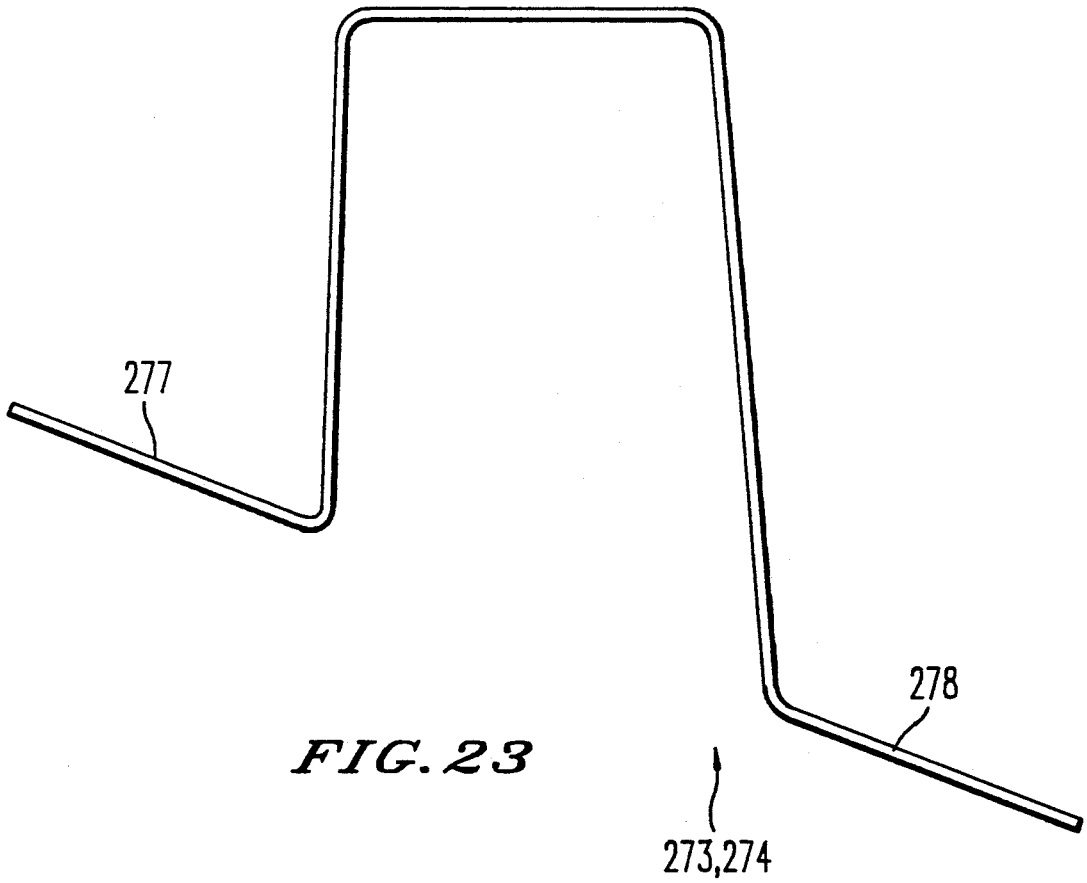
FIG. 23 is a sectional end view of a bottom chord of a diminishing truss taken on line 23—23 on FIG. 11.

The construction of the diminishing trusses 270 will be generally as for the main trusses 210, 220 (see FIGS. 9 to 16), with two major differences. Firstly, as shown in FIGS. 19, 21 and 22, the bottom chords 273, 274 extend pass the junctions with the top chords 275, 276. This enables the trusses to span, and be fixed to, the main trusses 220 of the main wing to either side of the side wing—see FIG. 19. Secondly, the bottom chords 273, 274 have the "modified top-hat" profile shown in FIG. 23 where the side flanges 277, 278 are co-planar but inclined relative to the vertical plane through the section. The angle of inclination of the flanges corresponds to the inclination of the top chords 222 of the main trusses 220 and the flanges 277, 278 are fixed to the base webs 243 of the top chords by "Tek-screws" or other suitable fasteners. This enables the "diminishing" trusses 270, 272 to be easily fixed to the main trusses 210, 220.

Figure 24:
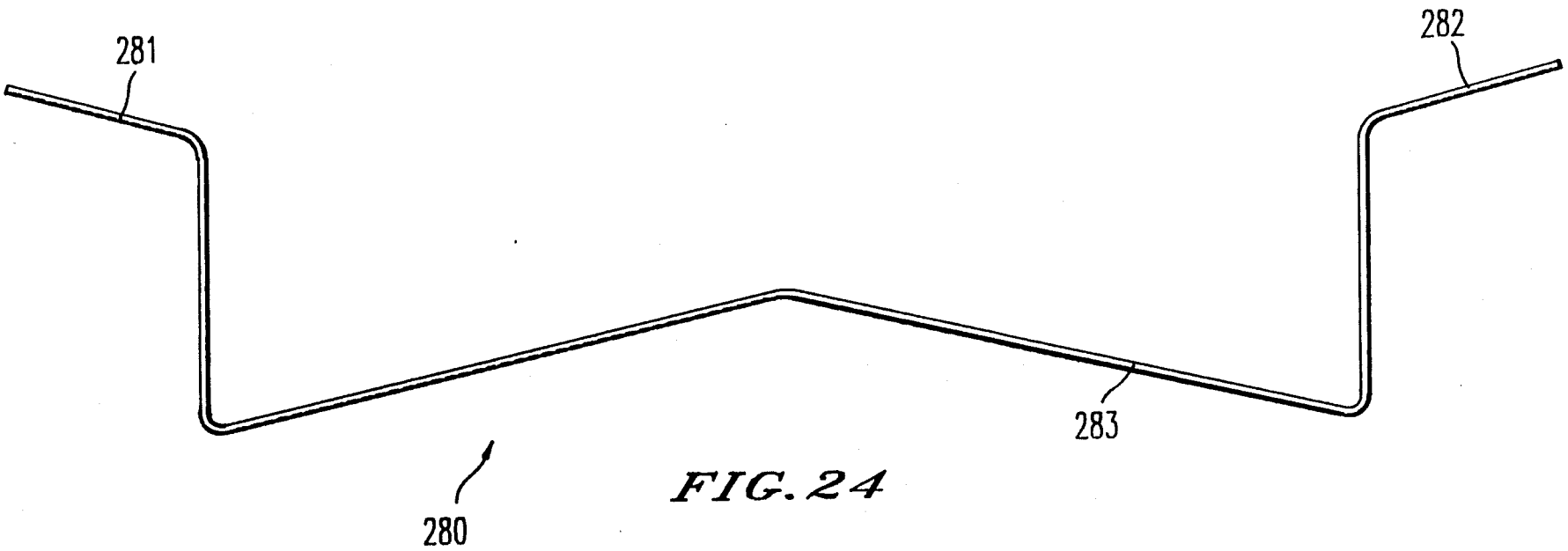
FIG. 24 is a sectional end view of a valley gutter for use with the diminishing roof trusses.

Referring now to FIG. 24, this shows an end view of a valley gutter 280 to be used with the diminishing trusses 270, 272. As the gutter 280 runs diagonally to both the main trusses 210, 220 and the diminishing trusses 270, 272, it has upwardly inclined side flanges 281, 282 to be fixed to roof purlins supported by the top chords 212, 222 and 275, 276 thereof (by e.g. "Tek-screws") as it is laid down the valley prior to the roof sheeting being installed. The V-shaped floor 283 enables the gutter 280 to nest on the extension at the ends of the bottom chords 273, 274 of the diminishing trusses.

Once the roof trusses have been positioned and fixed, the internal wall panels may be positioned.

Figure 25:
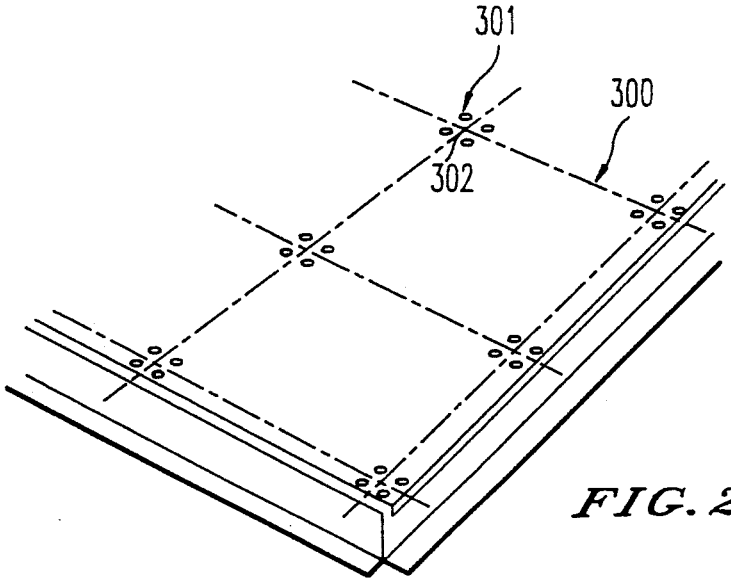
FIG. 25 is a perspective view showing the layout grid for the internal walls.

Referring to FIG. 25, the basis of the location of the internal wall system is a grid 300 (e.g at 945 mm centers) with a 4 hole×(e.g. 38 mm) square pattern 301 layout at each intersection 302 through which the panel brackets 303 (see FIGS. 26 to 29) may be fixed. (The panel brackets 303 are an alternative embodiment to the wall panel brackets 25 shown in FIG. 1.)

Each wall bracket 303 has four holes 304, 305 in its horizontal foot 306 and a slotted hole 307 in its vertical leg 303. The holes 304 are spaced a distance d from the center line of the vertical leg 308 which is one half of the distance D between the holes 301 at the intersection 302 (and which is also the distance of holes 305 from the vertical leg 308 of the bracket and the thickness of the wall panels).

Figure 26:
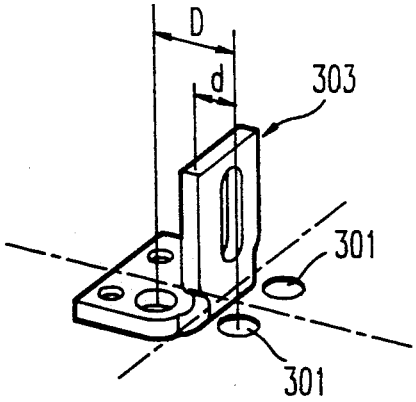
FIGS. 26 to 29 show alternative positions for the wall bracket to receive the wall panels on and off the grid lines.
Figure 27:
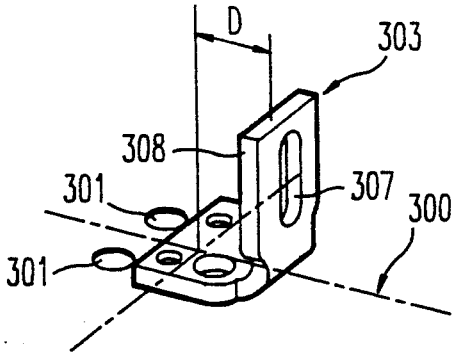
Figure 28:
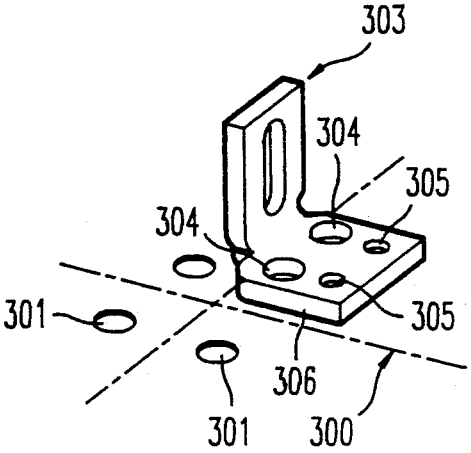

For wall panels which have their center line located on a grid line and whose end(s) start and/or finish at the intersection 302 (e.g. 938 mm panels on a 945 mm grid), the bracket 303 should be fixed with its vertical leg 308 directly over the intersection 302 of the grid lines (see FIG. 26). In this position, the holes 304 will be aligned with the holes 27 in the floor (see FIG. 1).

Figure 29:
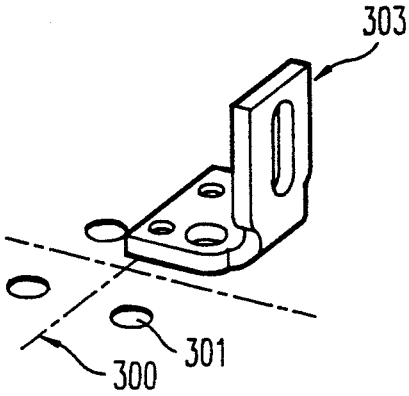
Figure 30:
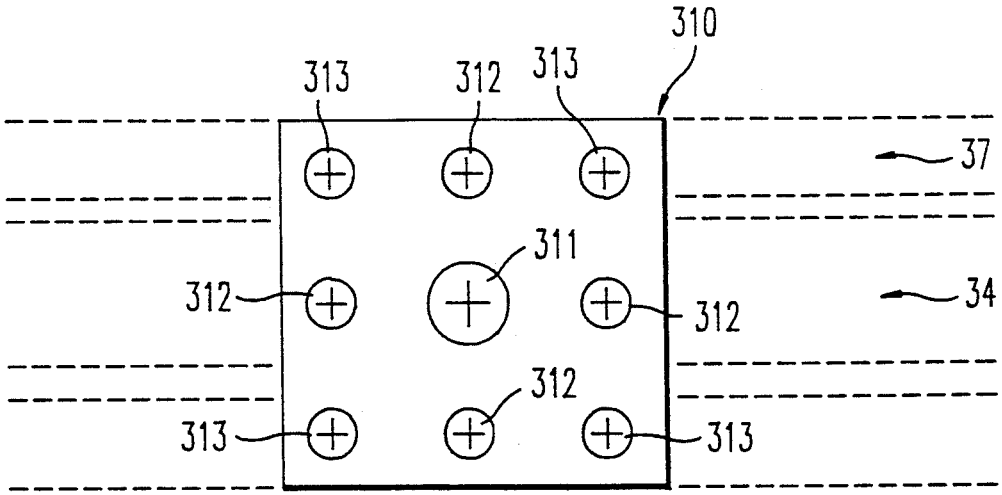
FIG. 30 is a plan view of the wall panel to roof truss location plate.

However, the system allows the wall panels to be offset relative to the grid 300. For example, with the wall panels having their center lines located on the grid 300 but their ends stepped off the grid (e.g. a 900 mm panel), the bracket 303 is rotated through 180° (see FIG. 27) so that the center line of the vertical leg is the distance D from the intersection 302. Similarly, the bracket 303 may be positioned to fix the wall panel with its center line off the grid 300 but its end on the grid (FIG. 28) or with both the panel center line and panel end off the grid (FIG. 29). It will be noted that in the arrangements of FIGS. 28 and 29, only one of the holes 304 is used to fix the wall bracket 303 to the floor. (Where the wall panel does not span a grid e.g. where the panel incorporates a doorway, the bracket 303 is fixed to the floor using two "Tek-screws" through holes 305).

Where the walls use panels of two different lengths e.g. 938 mm for the exterior panels and some interior panels and e.g. 900 mm for some interior panels, the distance D is equal to the difference in the panel lengths (e.g. D=938−900=38 mm).

The tops of the panels are anchored to the roof trusses 34 (see FIG. 1) using brackets 41. As the wall panels can be offset relative to the roof trusses 34, a fixing plate 310 is fixed to the underside of the bottom chord 37 (shown in plan view in dashed lines). Where the wall panels are on the grid lines 300 and their ends are at the intersection 302 (as in FIG. 26), the threaded stud 46 on the bracket passes through the central hole 311 in the plate and central hole 40 in the bottom chord 37 to fix the panel and plate to the chord. However, if the panels are on the grid lines 300 but their ends are offset (e.g. as in FIG. 27), a bolt passes through central hole 311 to fix the plate 310 to the bottom chord and the threaded stud 46 on the bracket passes through one of the aligned holes 312 in the plate 310, two of the holes being aligned with the side holes 40 in the bottom chord. If the panels are off the grid, then the plate 310 is bolted to the chord 37 and the threaded stud 46 will be secured in one of the corner holes 313 in the plate 313 in the plate 310 (which will necessitate drilling a corresponding hole in the bottom chord 37).

Figure 31:
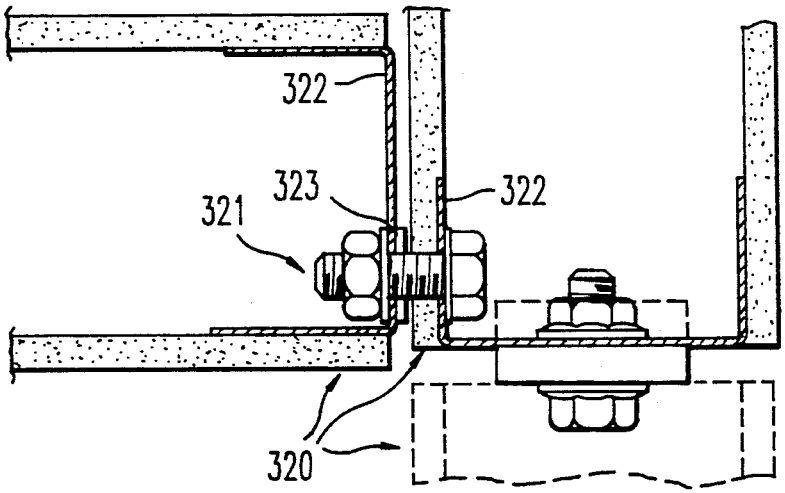
FIGS. 31 and 32 are plan views of alternate intersections of two wall panels.
Figure 32:
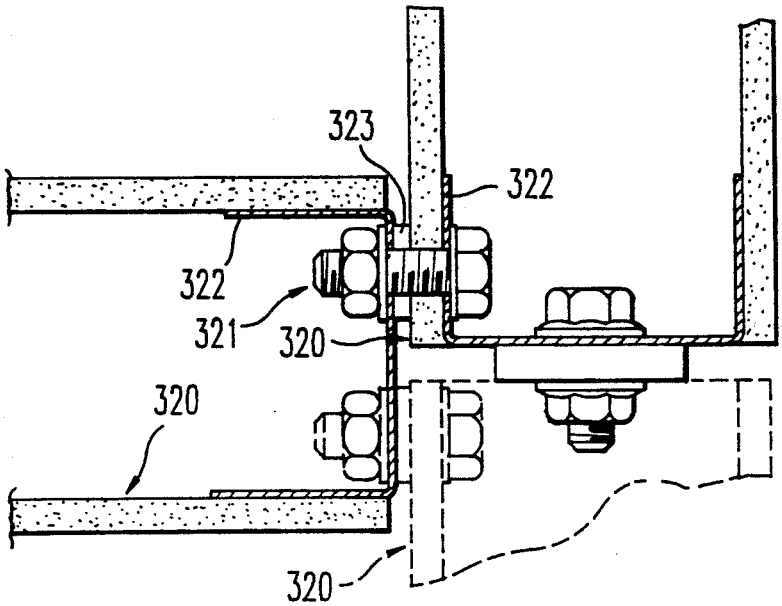

Referring now to FIGS. 31 and 32, these shown in plan view, the internal wall panels 320 can be fixed with their ends aligned (FIG. 31) or overlapping (FIG. 32), when the bolts 321 engage the respective studs 322 of the panels to ensure effective transfer of any loads therebetween. A spacer washer 323 is provided between the end of one panel and the skin of the second panel at the corner.

Because the internal wall panels can be stepped off the grid lines, it allows simpler fixing of the panels e.g. where windows and doors occur and the offset, being half the thickness of the panel, and allows the faces of panels to be positioned on the grid lines (e.g. see FIG. 31).

It will be readily apparent to the skilled addressee that the present invention provides a simple, strong and easy-to-erect method of modular building construction.

Various changes and modifications may be made to the embodiments described without departing from the scope of the present invention defined in the appended claims.

We claim:

1. A building structure including:

a floor assembly on a plurality of stumps or piles;

a plurality of wall panels secured to the floor assembly;

a plurality of roof truss frames supported on and secured to the wall panels;

first bracket means securing the wall panels to the floor assembly; and second bracket means securing the roof truss frame to the wall panel, each of said first and second bracket means being received between adjacent wall panels;

wherein:

said wall panels are arranged such that any loads between the floor assembly and the roof truss frames are transferred through the wall panels; and said floor assembly comprises a floor assembly frame and said wall panels comprise peripheral frames having stiles, each of said first bracket means to secure the wall panels to the floor assembly is of substantially L-shape in side view and has a foot section arranged to be bolted to the floor assembly frame and a leg section to be received between, and bolted to, the stiles in the peripheral frames of the adjacent wall panels.

2. A building structure including:

a floor assembly on a plurality of stumps or piles;

a plurality of wall panels secured to the floor assembly;

a plurality of roof truss frames supported on and secured to the wall panels;

first bracket means securing the wall panels to the floor assembly; and second bracket means securing the roof truss frames to the wall panel, each of said first and second bracket means being received between adjacent wall panels;

wherein said wall panels are arranged such that any loads between the floor assembly and the roof truss frames are transferred through the wall panels, and each wall panel has a peripheral metal frame to which is bonded or fixed a pair of cladding sheets and the cavity therein is filled with insulating foam.

3. A structure according to claim 1 wherein:

said floor assembly comprises a floor assembly frame and said wall panels comprises peripheral frames having stiles, each of said first bracket means to secure the wall panels to the floor assembly is of substantially L-shape in side view and has a foot section arranged to be bolted to the floor assembly frame and a leg section to be received between, and bolted to, the stiles in the peripheral frames of the adjacent wall panels.

4. A structure according to claim 3 wherein:

the second bracket means to secure the wall panels to the roof truss frames have a leg arranged to be received between, and bolted to, the stiles of the peripheral frames of the adjacent wall panels and a vertical threaded shaft which passes through the roof truss frame and is secured thereto by fastener means.

5. A building structure including:

a floor assembly supported on a plurality of piles or stumps;

a plurality of wall panels secured to the floor assembly;

a plurality of roof truss frames supported on and secured to the wall panels;

first bracket means securing the wall panels to the floor assembly; and second bracket means securing the roof truss frame to the wall panel means, each bracket means being received between adjacent wall panels;

wherein:

the floor assembly includes a peripheral frame having longitudinal bearers comprising a plurality of assembled I-beams, each I-beam being assembled from a pair of substantially identical C-section beams, wherein each C-section beam has a web member interconnecting a pair of substantially identical C-section beams, wherein each C-section beam has a web member interconnecting a pair of substantially parallel side flange members directed to one side of the web member, the C-section beams being arranged with their web members back-to-back and interconnected by aligned tab members and slots in the web members;

at least one lateral beam or joist is connected thereto, each lateral beam or joist having a web between a pair of parallel side flanges, the lateral beam or joist being received between a pair of the side flange members of the longitudinal bearers;

first fastener means engaged in respective aligned holes in the lower of the side flanges in the lateral beam or joist and the lower of the side flange members of the longitudinal bearer to secure the peripheral frame to the stumps or piles; and second fastener means engaged in respective aligned holes in the upper of the side flanges of the lateral beam or joist, the upper of the side flange members of the longitudinal bearer and the first bracket means to secure the wall panels to the floor assembly;

so arranged that any loads between the floor assembly and the roof truss frames are transferred through the wall panels.

6. A structure according to claim 5 wherein:

each wall panel has a peripheral metal frame to which is bonded or fixed a pair of cladding sheets and the cavity therein is filled with insulating foam, the wall panels being so arranged to distribute a load applied at one position in the panel throughout the panel.

7. A structure according to claim 5 wherein:

each of said first bracket means to secure the wall panels to the floor assembly is of substantially L-shape in side view and has a foot section arranged to be bolted to the floor assembly frame and a leg section to be received between and bolted to, the stiles in the peripheral frames of the adjacent wall panels.

8. A structure according to claim 5 wherein:

the second bracket means to secure the wall panels to the roof truss frames have a leg arranged to be received between, and bolted to, the stiles of the peripheral frames of the adjacent wall panels and a vertical threaded shaft which passes through the roof truss frame and is secured thereto by fastener means.

9. A structure according to claim 5 wherein:

each C-section beam has a plurality of tab members formed out the web member directed outwardly therefrom in the opposite direction to the side flange members, and a slot or hole formed in the web member adjacent each tab member, each tab member of each C-section beam entering the corresponding slot or hole of the other C-section beam, the tab members being deformed to engage the web members of the other C-section beam to secure the C-section beams together.

10. A structure according to claim 9 wherein:

each tab member has a leg extending substantially perpendicularly to the web member and a toe member substantially parallel to, but spaced from, the web member;

each lateral beam or joist has a slot in its web adjacent the end received in the longitudinal bearer; and one end of the tab member of the longitudinal bearer is engaged in the slot to assist in the connection of the lateral beam or joist to the longitudinal bearer.

11. A structure according to claim 10 wherein:

the slot in the web is spaced from the end of the lateral beam or joist a distance substantially equal to the height of the leg of the tab member, and the toe of the tab member is engaged in the slot and deformed to create a hook to secure the lateral beam to the longitudinal bearer.

12. A structure according to claim 5 wherein each roof truss frame is of the type having a pair of inclined top chords and base chord braced by inclined struts wherein:

the chords and struts are formed of top had and/or C-section sheet metal components and at each junction between two chords or a chord and a strut, one of the components is received within, and fixed to, the other of the components; and the metal components are roll-formed from sheet metal strip and have downwardly divergent side walls to enable the components to be nested together at the junction.

13. A structure according to claim 5 wherein each roof truss frame is of the type having a pair of inclined top chords and base chord braced by inclined struts wherein:

the top chord and struts are formed of top hat or C-section sheet metal components, the base chords are formed of modified top-hat section sheet metal components wherein the side flanges of the chord are coplanar and inclined to the longitudinal axis of the base chord; and wherein at each junction between two chords or a chord and a strut, one of the components is received within, and fixed to, the other of the components.

14. A structure according to claim 13 wherein:

the bottom chord extends beyond its junction, with the top chords to span two or more roof trusses arranged laterally to the first truss.

15. A structure according to claim 5 wherein each roof truss frame has a bottom chord of substantially top-hat section with horizontal side flanges, arranged in spaced parallel arrangement;

at least one ceiling batten interconnects a pair of the roof truss frames, the ceiling batten having a tab adjacent each end thereof to releasably secure the end of the batten to the horizontal side flange of the bottom chord with which it is engaged.

16. A structure according to claim 15 wherein:

the ceiling batten is of substantially U-section and the tab is formed out of, and lies in parallel, spaced relationship relative to, the central web of the ceiling batten.

* * * * *